US009077064B2

(12) United States Patent
Franzon et al.

(10) Patent No.: US 9,077,064 B2
(45) Date of Patent: Jul. 7, 2015

(54) MICROWAVE TRANSMISSION ASSEMBLY

(75) Inventors: Bosse Franzon, Bro (SE); Jan-Erik Lundberg, Sollentuna (SE); Rune Johansson, Upplands Väsby (SE); Torbjörn Lindh, Huddinge (SE); Claudia Muñiz Garcia, Stockholm (SE); John David Rhodes, Menston (GB)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 474 days.

(21) Appl. No.: 13/511,268

(22) PCT Filed: Nov. 23, 2010

(86) PCT No.: PCT/SE2010/051291

§ 371 (c)(1),
(2), (4) Date: May 22, 2012

(87) PCT Pub. No.: WO2011/065902

PCT Pub. Date: Jun. 3, 2011

(65) Prior Publication Data

US 2012/0229229 A1 Sep. 13, 2012

(30) Foreign Application Priority Data

| | | |
|---|---|---|
| Nov. 24, 2009 | (GB) | 0920545.1 |
| Jan. 25, 2010 | (GB) | 1001150.0 |
| Mar. 8, 2010 | (GB) | 1003764.6 |
| Mar. 11, 2010 | (GB) | 1004062.4 |
| Mar. 16, 2010 | (GB) | 1004129.1 |

(51) Int. Cl.

| | |
|---|---|
| ***H01P 5/18*** | (2006.01) |
| ***H01P 1/213*** | (2006.01) |
| *H01P 5/04* | (2006.01) |

(52) U.S. Cl.
CPC ..... *H01P 1/213* (2013.01)

(58) Field of Classification Search
CPC ..... H01P 5/02; H01P 5/04; H01P 5/18; H01P 5/184; H01P 5/185; H01P 5/187
USPC ..... 333/109, 110, 111, 112, 116, 117; 361/119
See application file for complete search history.

(56) References Cited

U.S. PATENT DOCUMENTS

| | | | |
|---|---|---|---|
| 2,939,093 | A | 5/1960 | Marie |
| 3,200,352 | A | 8/1965 | Lee |

(Continued)

FOREIGN PATENT DOCUMENTS

| | | | |
|---|---|---|---|
| CN | 1089358 | A | 7/1994 |
| CN | 101084622 | A | 12/2007 |

(Continued)

*Primary Examiner* — Dean Takaoka
(74) *Attorney, Agent, or Firm* — Murphy, Bilak & Homiller, PLLC

(57) ABSTRACT

According to one or more embodiments, a directional filter assembly (10) comprises a multi-port filter circuit (12) for combining or separating signals in specified pass-bands and an isolated port (20) having a resistive load (22), for absorbing out-of-band signals. The assembly further includes a reflective protection device (24) configured to protect the resistive load (22) from being overpowered by out-of-band signal power, based on being configured to reflect or not reflect the out-of-band signals in dependence on the level of out-of-band signal power. In at least one embodiment, the directional filter assembly is configured as a microwave transmission assembly, such as is used for combining signals from two or more base stations, for transmission from a common antennae assembly.

19 Claims, 9 Drawing Sheets

(56) References Cited

U.S. PATENT DOCUMENTS

| | | | | |
|---|---|---|---|---|
| 3,202,942 | A | 8/1965 | Garver et al. | |
| 3,521,197 | A | 7/1970 | Broderick | |
| 5,884,149 | A * | 3/1999 | Jaakola | 455/103 |
| 6,803,818 | B2 * | 10/2004 | van Amerom | 330/144 |
| 6,972,638 | B2 * | 12/2005 | Usami et al. | 333/109 |
| 7,187,910 | B2 * | 3/2007 | Kim et al. | 455/115.3 |
| 7,671,699 | B2 * | 3/2010 | Wren | 333/109 |
| 8,625,247 | B2 * | 1/2014 | Goebel et al. | 361/119 |

FOREIGN PATENT DOCUMENTS

| | | | |
|---|---|---|---|
| JP | H11168302 | A | 6/1999 |
| WO | 2010027310 | A1 | 3/2010 |

* cited by examiner

MICROWAVE TRANSMISSION ASSEMBLY

TECHNICAL FIELD

The present invention relates to a directional filter assembly, which may be used for combining or separating signals in a microwave transmission assembly. More particularly, but not exclusively, the present invention relates to a power-dependent reflective protection device that selectively reflects power away from a termination load of the directional filter assembly.

BACKGROUND

Base stations for generating microwave signals are known in the field of mobile telephony. Such base stations are connected to an antenna for transmitting the signals generated by the base stations to mobile telephones.

Often a plurality of base stations is connected to a single antenna. Each of the base stations may generate a microwave signal at a different frequency and different modulation scheme as is known in the art. In this case, each of the plurality of base stations is connected to an associated input port of a combiner. The combiner combines the signals from the input ports together and presents them at an output port, which is in turn connected to the antenna.

It is possible that the base stations may be incorrectly connected to the combiner or that transmit frequencies are incorrectly configured with respect to the respective pass-bands of the combiner. For example a base station adapted to generate a signal at one frequency may be accidentally connected to an input port of the combiner adapted to receive a signal at a different frequency. In such cases, and for certain types of combiners, such as directional-filter type combiners, the power from the incorrectly connected base station is delivered to an internal termination load in the combiner.

If some or all of the power from a base station is delivered to the internal termination load in the combiner then the apparatus will not operate correctly or possibly not at all. Permanent damage to the combiner, and especially to the internal termination load, may occur. Further, it can be difficult to determine the cause of such problems, and complex diagnostic systems may be required.

SUMMARY

In one aspect of the teachings presented herein, a directional filter assembly is configured to prevent excessive power dissipation in its internal termination load by selectively reflecting power away from the internal termination load in a power-dependent fashion. For example, if the power that otherwise would be directed into the internal termination load is below a certain threshold, the directional filter assembly does not reflect that power away from the internal termination load. This can be understood as normal, non-reflective operation of the directional filter assembly. On the other hand, if the power level exceeds a certain threshold, the directional filter assembly reflects power away from the internal termination load, thereby preventing excessive power dissipation in the internal termination load.

Accordingly, in one embodiment, a reflective protection device is configured to protect the internal termination load of a directional filter assembly. The reflective protection device comprises, for example, a power-dependent reflective circuit that is coupled to the internal output port of the directional filter assembly, where the internal output port is also referred to as an "isolated" port of the directional filter assembly. The power-dependent reflective device directly or indirectly senses the incident out-of-band signal power level with respect to the internal termination load. As one example, thermal sensing is used. As another example, a microwave power sensor is used.

In any case, the sensed level of power can serve as a trigger, for changing the operation of the reflective protection device from a non-reflective state, where it may be transparent in a circuit sense and does not interfere with power absorption by the internal termination load, to a reflective state, where it reflects the out-of-band signal power away from the internal termination load. Here, it will be understood that "away from the internal termination load" means that out-of-band signal power that otherwise would be dissipated in the internal termination load is instead reflected elsewhere, such as back into the isolated port.

Such operational features make the contemplated directional filter assembly advantageous for a number of applications. In a non-limiting example, the directional filter assembly is configured as a combiner within a microwave transmission assembly. The combiner includes first and second input ports and internal and external output ports; the combiner being adapted to transfer a signal received at a microwave frequency range $f_1$ at the first input port to the external output port, which is also referred to as a common port, and signals received at other frequencies to the internal output port, which is also referred to as an isolated port; the combiner being further adapted to transfer a signal received at a microwave frequency range $f_2$ at the second input port to the external output port and signals received at other frequencies to the isolated port; a resistive load connected to the isolated port as the earlier-named internal termination load; and, a power dependent reflective protection device configured to protect the resistive load from being overloaded, based on the reflective protection device changing reflectivity as a function of the power being dissipated in the resistive load.

In at least one embodiment, the reflective protection device is configured to protect the resistive load from being overpowered by incident power from the isolated port, based on being configured to switch from a non-reflective state wherein incident power passes to said resistive load, to a reflective state wherein incident power is reflected away from the resistive load. The changeover in behavior is tied to the level of out-of-band signal power at the resistive load. As such, the reflective protection device protects the resistive load from damage that could otherwise arise from excessive power dissipation in the resistive load, such as might occur when a base station is incorrectly coupled to the combiner or the transmit frequencies are incorrectly allocated.

One or more of the embodiments taught herein are particularly well suited for use in remotely controlled combiners. This is because remote control of combiner pass-band frequency and transmit frequency allocation may increase the risk of mistakes and makes validation of retuning and reallocation more difficult or even impossible.

In at least one embodiment taught herein, the reflective protection device is configured as a shunt device that appears as a high-impedance shunt when in the non-reflective or standby state, and appears as a low-impedance shunt when in the reflective or active state. In at least one such embodiment, a thermal sensor or another control sensor monitors power dissipation in the resistive load, for triggering the change from non-reflective to reflective states. In another embodiment, the reflective protection device is self-triggered, e.g., it changes from the non-reflective state to the reflective state based on, for example, the voltage at the resistive load.

Generally, it will be understood, for example, that injecting the wrong frequency signal into one of the combiner's input ports will cause power dissipation in the resistive load to increase. Excessive power dissipation in the resistive load because of such error causes the reflective protection device to switchover from its non-reflective or standby state to its reflective state or active state.

As such, if a base station is incorrectly connected to the combiner of the microwave transmission assembly according to the invention, then the power transmitted to the resistive load will increase and, beyond a given threshold, causing the reflective protection device to reflect power back to the incorrectly connected base station. This action provides an immediate indication that the base station has been incorrectly connected to the combiner.

Preferably, the microwave transmission assembly further comprises an antenna for transmitting a microwave signal, the antenna being connected to the external output port. Preferably, at least one of the input ports has a base station connected thereto, the base station being adapted to provide a microwave signal to the combiner.

Preferably, the power limit which causes the reflective protection device to switchover is at least 10% and less than 90% of the power in the microwave signal generated by the base station, and more preferably greater than 20% and less than 75%. The base station can comprise a detector for detecting power reflected from the combiner. The base station can be adapted to provide a modulated microwave signal, preferably a Global System for Mobile Communications (GSM), Wideband Code Division Multiple Access (W-CDMA) or Long Term Evolution (LTE) modulated signal.

BRIEF DESCRIPTION OF THE DRAWINGS

The present invention will now be described by way of example only and not in any limitative sense with reference to the accompanying drawings in which.

DETAILED DESCRIPTION

Figure 1:
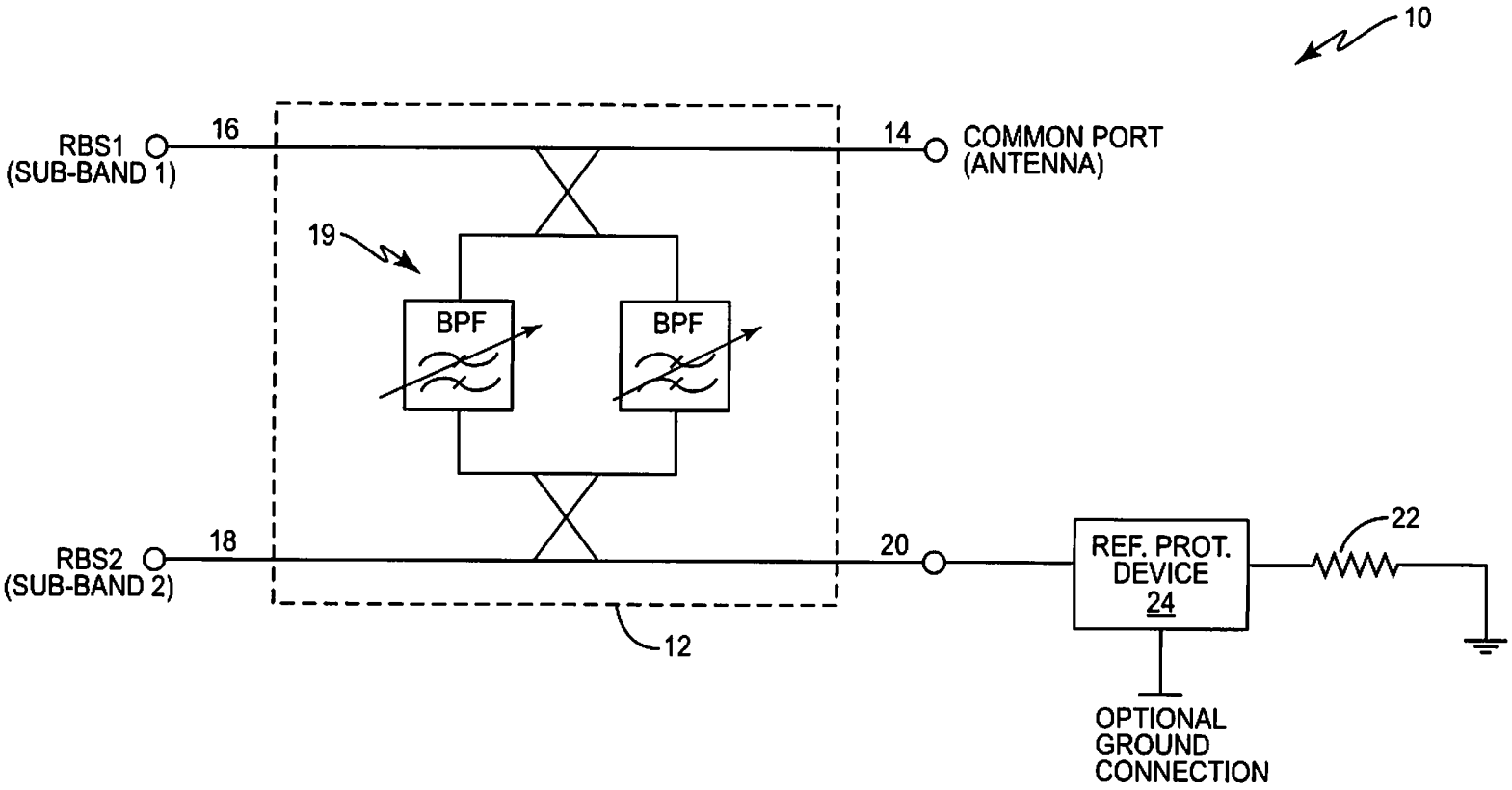
FIG. 1 shows an embodiment of a directional filter assembly that includes a reflective protection device.

Directional filters are used for combining or separating signals at given frequency ranges or sub-bands and it is broadly contemplated herein to include a reflective protection device in a directional filter assembly, to provide protection for the filter's internal termination load. FIG. 1 illustrates one embodiment of a contemplated directional filter assembly 10, which includes a directional, multi-port filter circuit 12 configured as a combiner in a microwave assembly that multiplexes signals from two base stations onto a common port 14. In particular, the common port 14 is depicted as a common antenna port, and microwave signals in Sub-band 1 are applied by a first base station RBS1 to a first input port 16, while microwave signals in Sub-band 2 are applied by a second base station RBS2 to a second input port 18.

As is known for directional filters, the directional filter assembly 10 directs out-of-band signals to its internal output port, which is referred to as an isolated port and is identified by reference number 20 in the illustration. One sees band-pass filter circuits 19 in the multi-port filter circuit 12, to provide for desired pass-band/out-of-band behavior.

The out-of-band signals are passed to the isolated port 20 and the directional filter assembly 10 includes an internal termination load for dissipating out-of-band signal power from the isolated port 20. In the illustration, the internal termination load is represented by a resistive load 22.

Advantageously, the directional filter assembly 10 includes a reflective protection device 24, which functions as a power dependent reflective load and thereby protects the resistive load 22 from dissipating excessive, potentially damaging levels of out-of-band signal power. As an example, the resistive load 22 comprises a 50 Ohm resistor or other impedance-matching termination that, in normal operation of the directional filter assembly 10, prevents out-of-band signals from being reflected from the directional filter 12. As such, it will be understood that the directional filter assembly 10 is sometimes also referred to as a "non-reflective" filter. However, the injection of excessive out-of-band signal power into the directional filter assembly 10 can overpower the resistive load 22. Correspondingly, the reflective protection device 24 operates in a non-reflective state or in a reflective state, and it changes from the non-reflective state to the reflective state in dependence on the out-of-band signal power level, to protect the resistive load 22 from damage.

One also sees in the illustration that the reflective protection device 24 is depicted as having an optional ground configuration. This aspect of the illustration is meant to indicate that some embodiments of the reflective protection device 24 use a ground connection, while others do not necessary have such a connection. In embodiments that use a ground connection, the reflective protection device 24 may be physically configured to have good thermal conduction into that ground connection, thus making it more robust.

With the above arrangement in mind, one or more embodiments of the teachings presented herein provide a directional filter assembly 10 comprising a multi-port filter circuit 12 for combining or separating signals in specified pass bands and an isolated port 20 having a resistive load 22, for absorbing out-of-band signals. The directional filter assembly 10 further comprises a reflective protection device 24 that is configured to protect the resistive load 22 from being overpowered by out-of-band signal power, based on being configured to reflect or not reflect the out-of-band signals in dependence on the level of out-of-band signal power.

The reflective protection device 24 may be triggered based on a sensor or other detector that is configured to directly or indirectly sense the out-of-band signal power level. In another embodiment, the reflective protection device 24 is self-triggering, e.g., it switches from its non-reflective state to its reflective state responsive to the voltage level at the resistive load, or responsive to another parameter that depends on out-of-band signal power level.

Figure 2:
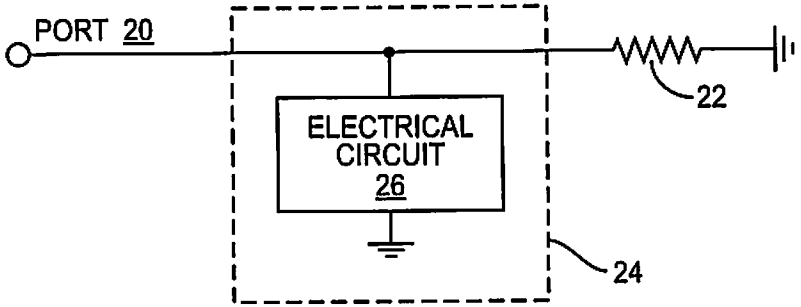
FIG. 2 shows an embodiment of the reflective protection device configured as a shunt-connected electrical circuit.

FIG. 2 illustrates one embodiment of the reflective protection device 24 comprising a shunt-connected electrical circuit 26. The electrical circuit 26 may include one or more devices that are configured to act as a high-impedance shunt for non-reflective operation of the reflective protection device 24, and to act as a low-impedance shunt, e.g., a short-circuit to ground, for reflective operation of the reflective protection device 24. A number of electrical circuits 26 are contemplated for this shunt configuration, including two terminal devices, such as pull-down transistors or voltage-dependent "break-over" devices.

Figure 3:
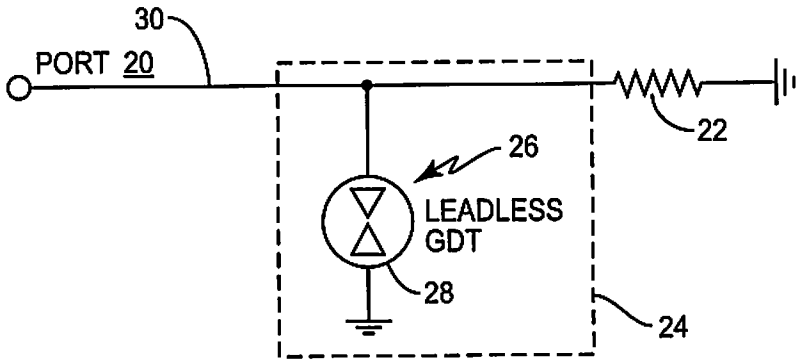
FIG. 3 shows an embodiment of the shunt-connected electrical circuit of FIG. 2, wherein a Gas Discharge Tube (GDT) is used in a shunt configuration.

FIG. 3 illustrates one example of using a break-over device for the electrical circuit 26. In particular, FIG. 3 illustrates the implementation of the electrical circuit 26 using a Gas Discharge Tube (GDT) 28 that is shunt-connected to isolated port 20. In at least one embodiment, the GDT 28 is configured as a "leadless" device for improved thermal performance. It will be understood that the GDT 28 can operate as a self-triggering version of the reflective protection device 24. That is, until the GDT 28 becomes active, it appears as a high-impedance shunt connection that does not meaningfully interfere with the dissipation of out-of-band signal power in the resistive load 22. This can be understood as the non-reflective state of operation for the reflective protection device 24 in this embodiment.

However, at a certain out-of-band signal level, the GDT 28 will become active and then appear as a low-impedance shunt on the transmission line 30 coupling the isolated port 20 to the resistive load 22. This can be understood as the reflective state of operation for the reflective protection device 24 in this embodiment. That action causes reflection of the out-of-band signals back into the isolated port 20, thereby protecting the resistive load 22.

Figure 4:
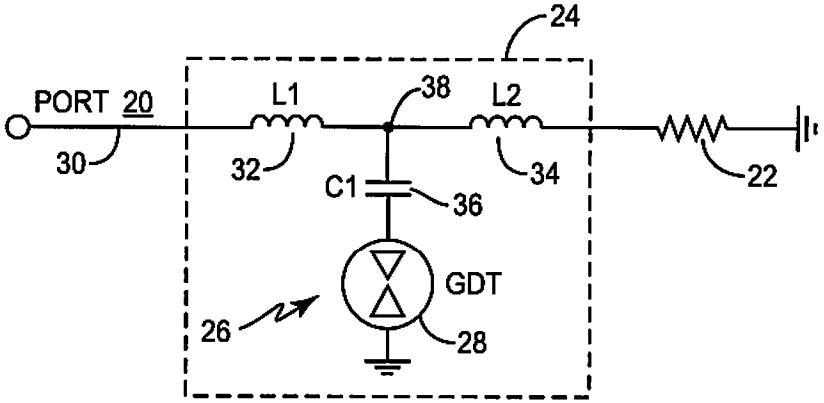
FIG. 4 shows another embodiment of a shunt-connected GDT.

FIG. 4 illustrates another embodiment of the reflective protection device 24, also where the shunt-configured electrical circuit 26 is implemented using a GDT 28. However, in FIG. 4, the impedance characteristics of the reflective protection device 24 are improved using a first series inductive element 32 (L1) that is electrically positioned between the isolated port 20 and the shunt-connected GDT 28 and a second series inductive element 34 (L2) positioned between the shunt-connected GDT 28 and the resistive load 22.

This arrangement forms a low-pass filter that improves a return loss of the reflective protection device 24. The impedance scaling provided by the inductors 32 and 34 can be used to set the trip point of the GDT 28 to a desired power level. As a further option, a capacitor 36 (C1) couples the shunt-connected GDT 28 to a common node 38 between the first and second inductive elements 32 and 34. The capacitor 36 is configured to mitigate an inductance of the shunt-connected GDT 28 in its reflective state; however, leadless implementations of the GDT 28 are inherently low-inductance and the capacitor 36 will not be needed in at least some implementations.

Figure 5:
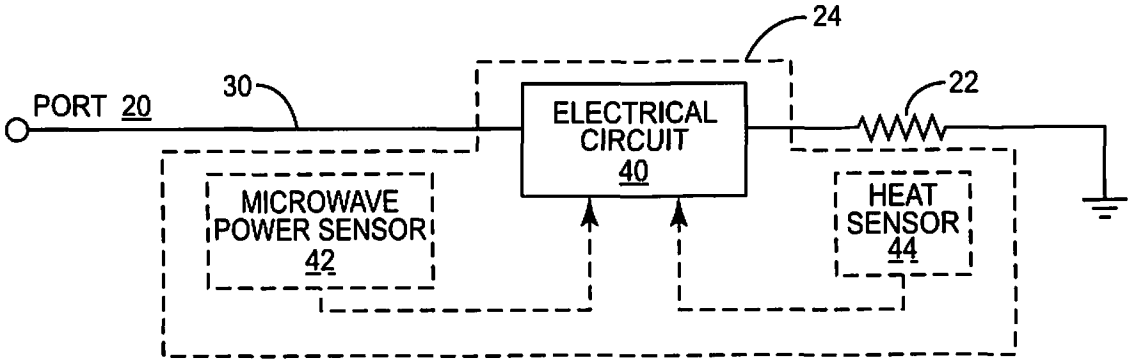
FIG. 5 shows another embodiment of the reflective protection device.

FIG. 5 illustrates another embodiment, where the reflective protection device 24 comprises an electrical circuit 40 that is not self-triggering and instead relies on a triggering signal. The illustration provides two example triggering circuits: a microwave power sensor 42 that is configured to generate a signal responsive to the sensed level of microwave power at or from the isolated port 20, and a heat sensor 44 that is configured to generate a signal responsive to heating of the resistive load 22.

It will be understood that the reflective protection device 24 can use either sensor 42 or 44 and that both sensors generally would not need to be used. It will also be understood that the power level at which it is desired to trigger reflective state operation of the electrical circuit 40 can be set in terms of a temperature level, in cases where the heat sensor 44 is used for triggering. Also, it should be noted that the electrical circuit 40 is depicted as interrupting the transmission line 30 but that is not a limitation of the embodiment. The electrical circuit 40 may comprise one or more shunt-connected electrical circuits, similar to that depicted in FIG. 2 with reference to the electrical circuit 26.

In this regard, the electrical circuits 26 and 40 may be understood as to operate as "triggered reflectors" that change from a non-reflective state to a reflective state in dependence on the out-of-band signal power level, with the difference being whether they are self-triggered or rely on an associated sensor for triggering. Broadly, it is contemplated to implement the reflective protection device 24 using a range of triggered reflectors, which may be implemented in shunt or series configurations with respect to connection between the isolated port 20 and the resistive load 22. Non-limiting examples include the use of shunt-configured electrical circuits, such as circuit 26. Within that configuration, a variety of electrical circuits are contemplated, including two-terminal devices such as pull-down transistors, GDTs, etc.

Figure 6:
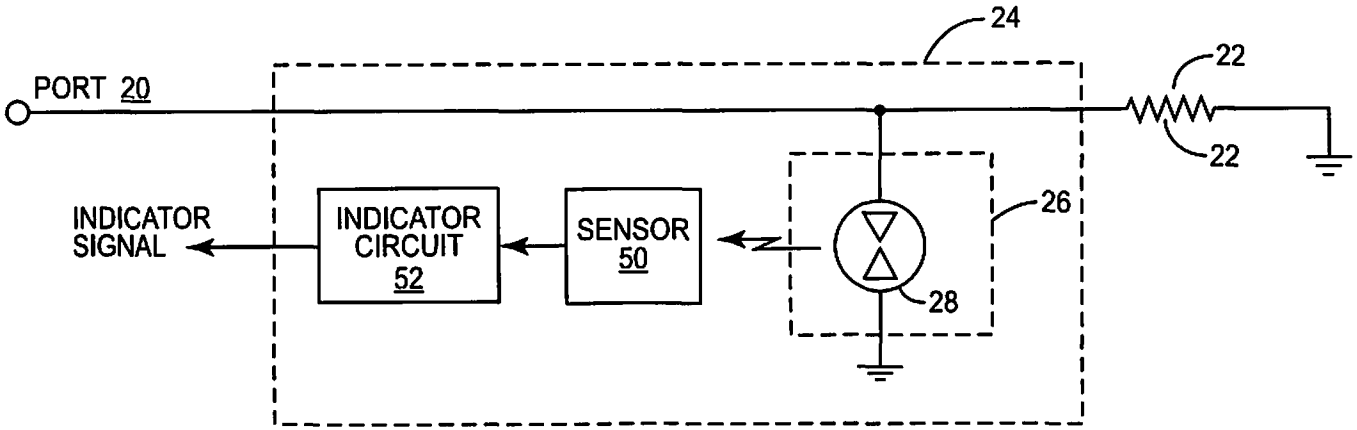
FIG. 6 shows yet another embodiment of the reflective protection device.

As another variation using GDTs, FIG. 6 illustrates another embodiment of the reflective protection device 24, wherein a shunt-configured electrical circuit 26 includes a GDT 28 that is associated with a sensor 50. The sensor 50 may be a photo or other "radiative" sensor that detects when the GDT 28 is operating in its active state—meaning that the sensor 50 provides a signal that indicates when the reflective protection device 24 is operating in its reflective state. In turn, that signal drives an indicator circuit 52, which may be a powered circuit. The indicator circuit 52 provides an indicator signal, which may serve as an alarm or other indication to, e.g., an external circuit or system, such as a base station.

Figure 7:
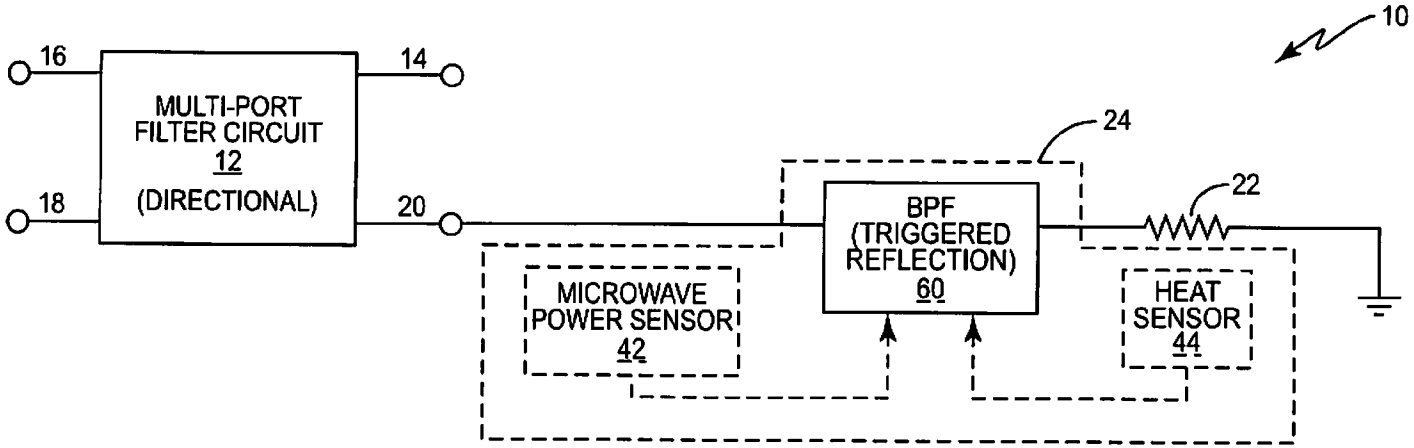
FIG. 7 shows another embodiment of the directional filter assembly introduced in FIG. 1, where the reflective protection device is implemented using a band-pass filter circuit.

FIG. 7 illustrates yet another embodiment of the reflective protection device 24 that is contemplated herein. In this configuration the reflective protection device 24 is implemented using a band-pass filter circuit 60 that is positioned between the isolated port 20 and the resistive load 22. In particular, the band-pass filter circuit 60 is configured to operate in a non-reflective state wherein it does not reflect out-of-band signal power, and to operate in a reflective state wherein it does reflect out-of-band signal power, and thereby protects the resistive load 22. As with other embodiments of the reflective protection device 24, the band-pass filter circuit 60 operates in either the non-reflective or reflective state in dependence on the out-of-band signal power level.

Some embodiments of the band-pass filter circuit 60 are self-triggered, while others use an associated sensor for triggering the switchover from the non-reflective state to the reflective state. By way of example, FIG. 7 depicts the band-pass filter 60 with a microwave power sensor 42 and a heat or thermal sensor 44, such as discussed earlier. In actual implementation, it is likely that only one of the two sensors 42 and 44 would be included, although redundant sensing could be used, or different triggering thresholds could be implemented using more than one sensor.

Figure 8:
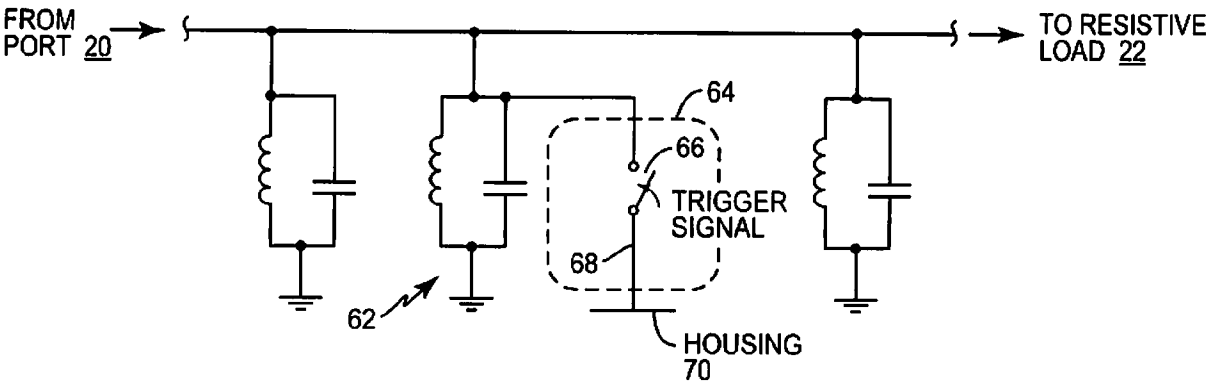
FIGS. 8-13 shown various embodiments for configuring a band-pass filter circuit to operate in a non-reflective or reflective state, in dependence on out-of-band signal power level.

FIG. 8 illustrates one embodiment of the band-pass filter circuit 60. One sees that a resonator 62 of the band-pass filter circuit 60 is configured to be switched or otherwise triggered in dependence on the out-of-band signal power level. To this end, the band-pass filter circuit 60 includes some type of actuator circuit 64 that operates on the resonator 62. For example, the actuator circuit 64 includes a switch 66 or equivalent device that selectively detunes or deactivates the resonator 62 by shorting to ground in response to a trigger signal. The switch or equivalent device 66 may have a ground connection 68 on one side. As an example, the ground connection 68 may be made by connecting to the housing 70 of the band-pass filter circuit 60. It will be understood that good thermal conductivity between the switch or equivalent device 66 makes it more robust with respect to the involved levels of out-of-band signal power. The switch or equivalent device 66 may be a two-terminal device in one or more embodiments and may be configured as a leadless device to improve its thermal characteristics.

Figure 10:
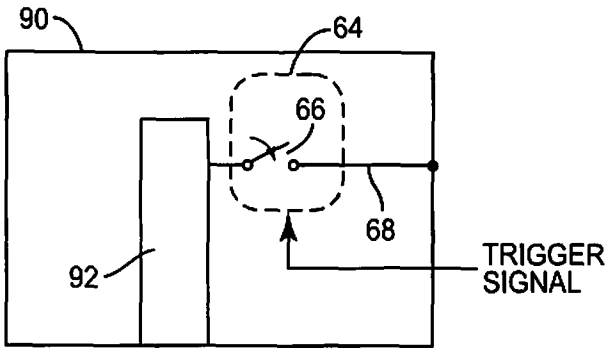
Figure 9:
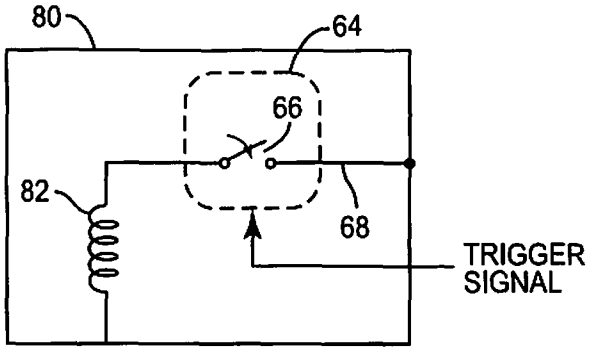
Figure 11:
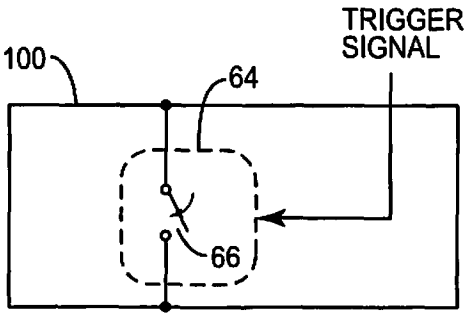

FIG. 9 illustrates another embodiment of a resonator 80 that can be included in a band-pass filter circuit 60, for controlling whether the band-pass filter circuit 60 operates in a non-reflective or reflective state. Here, a helical resonator 82 is selectively detuned or deactivated using an actuator circuit 64. Again, a triggering signal may be used to trigger the change from the non-reflective state to the reflective state. Similarly, FIGS. 10 and 11 illustrate similar configurations for a coaxial cavity resonator 90, including a resonator rod 92 (FIG. 10), and for a waveguide cavity resonator 100 (FIG. 11).

Figure 12:
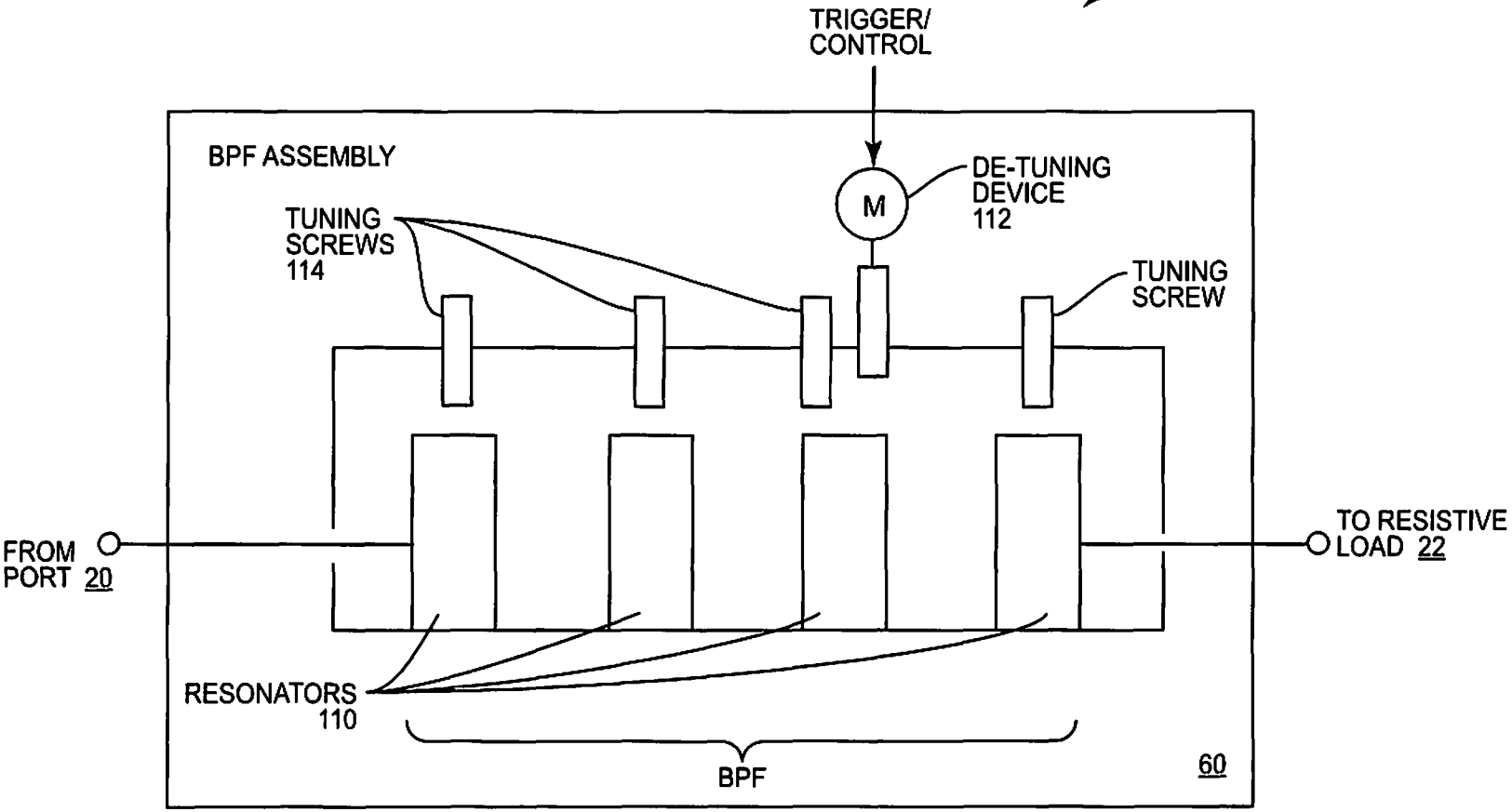

FIG. 12 illustrates another embodiment, where the band-pass filter circuit 60 comprises a number of series resonators 110 that pass out-of-band signals from the isolated port 20 to the resistive load 22 when the band-pass filter circuit 60 is operating in the non-reflective state. Conversely, the resonators 110 are reflective with respect to the out-of-band signals from the isolated port 20 when the band-pass filter circuit 60 is operating in the reflective state.

In this regard, the band-pass filter circuit 60 is controlled to operate in the non-reflective state or in the reflective state via a de-tuning device 112, which operates on one or more tuning screws 114 that control operation of resonators 110. Thus, by actuating or otherwise triggering the de-tuning device 112, the band-pass filter circuit 60 operates in its non-reflective state or in its reflective state in dependence on the out-of-band signal power level.

These and other contemplated configurations offer specific operational advantages. It should also be understood that the band-pass filter circuit 60 can be configured to be self-triggering, such as by including a GDT 28 or other self-triggering circuit configured to operate on one or more resonators within the band-pass filter circuit 60. For example, FIG. 13 illustrates another advantageous embodiment of a coaxial resonator 120 that can be used to control whether the band-pass filter circuit 60 operates as non-reflective device or as a reflective device.

Figure 13:
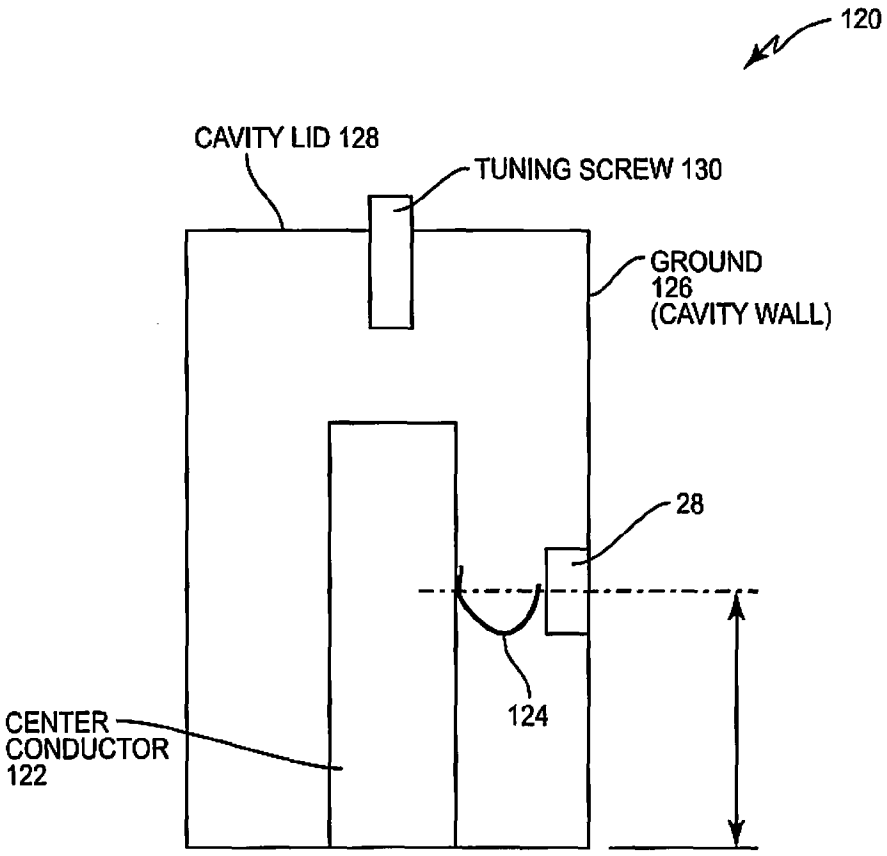

In FIG. 13, the center conductor or resonator rod 122 of the coaxial resonator 120 is connected to one side of a GDT 28 via a connection 124. The other side of the GDT 28 is connected to a ground 126, which may be the cavity wall of the coaxial resonator 120. That configuration has thermal advantages. In any case, it will be understood that the resonator 120 is detuned when the GDT 28 is activated, and that such activation changes the band-pass filter circuit 60 from its non-reflective state to its reflective state. In general, a GDT 28 or other circuit device can be configured to act on a resonator element within a resonator, e.g., a resonator rod or other element, such that activation or triggering of the GDT or other circuit device detunes the resonator.

The position of the GDT 28 along the longitudinal dimension of the resonator rod 122 can be used to set the trip point to a desired power level. Also, note that the coaxial resonator 120 also may be enclosed by a cavity lid 128, and may include a tuning screw 130 to tune its band-pass characteristics.

Figure 14:
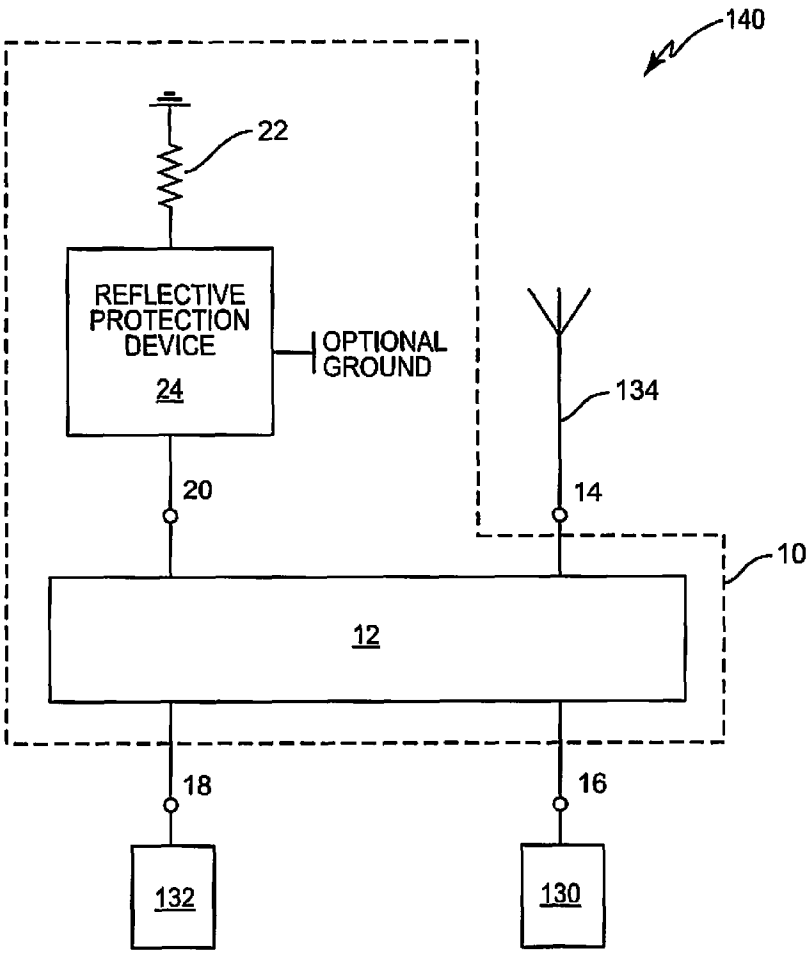
FIG. 14 shows an embodiment of a directional filter assembly configured as a microwave transmission assembly, for combining microwave signals from attached base stations.

FIG. 14 illustrates another embodiment contemplated herein, wherein the directional filter assembly 10 is used in a microwave transmission assembly 140. In particular, the multi-port filter circuit 12 of the directional filter assembly 10 is configured as a microwave combiner within the microwave transmission assembly 140.

Thus, one sees a first base station 130 connected to a first input port 16 of the directional filter assembly 10, and a second base station 132 connected to a second input port 18 of the directional filter assembly 10. The common output port 14, which also may be referred to as an external output port, is connected to one or more transmit antennas 134, and the isolated port 20 is connected to a reflective protection device 24, to protect the resistive load 22 as previously described.

This configuration is suitable for combining microwave signals from the two base stations 130 and 132, for transmission from the antenna 134. For example, the first base station 130 applies microwave signals in a first frequency range $f_1$ to the first input port 16, while the second base station 132 applies microwave signals in a second frequency range $f_2$ to the second input port 18.

In normal operation, signals applied to the first input port 16 that are out-of-band with respect to the first frequency range $f_1$ are directed to the isolated port 20 for dissipation by the resistive load 22 and signals applied to the second input port 18 that are out-of-band with respect to the second frequency range $f_2$ are also directed to the isolated port 20 for dissipation by the resistive load 22. Further, it will be understood that in normal operation, some amount of signal power generally is passed out of the isolated port 20, even in the absence of incorrect signal frequencies or base station misconnections.

In any case, in operation, the first base station 130 generates a microwave signal at a frequency range $f_1$. Typically this is modulated according to a modulation scheme, for example W-CDMA modulation, as is known in the art. The multi-port filter circuit 12 functions as a microwave combiner and receives this modulation signal and transfers it to the antenna 134. The second base station 132 also generates a microwave signal, which is received by the multi-port filter circuit 12 of the directional filter assembly 10, where it is combined with the first signal, and passed to the antenna 134. As noted, the microwave signal generated by the second base station 132 is typically of a different frequency range $f_2$ and may be modulated according to a different modulation scheme than the first microwave signal at frequency range $f_1$.

In this sense, the directional filter assembly 10 "expects" to receive a particular frequency range microwave signal at each input port 16 and 18. If a base station 130, 132 is connected to the wrong port 16, 18, or is set to provide the incorrect range of microwave frequencies, then the directional filter assembly 10 will not pass the microwave signal to the antenna 134. Instead, the multi-port filter circuit 12 of the directional filter assembly 10 will pass the out-of-band signal to the resistive load 22 where it is dissipated—at least, it will do so subject to the level of out-of-band signal power dissipation that triggers the reflective protection device 24 and causes it to change from its non-reflective state to its reflective state.

By controlling whether the protective reflection device 24 operates in the reflective state or in the non-reflective state as a function of the out-of-band signal power level, the directional filter assembly 10 offers built-in protection against overpowering the resistive load 22, such as might happen with improperly connected base station signals. In this regard, the reflective protection device 24 can be understood as a power dependent reflective load that acts to protect the resistive load 22. Also, as earlier noted, the reflective protection device 24 may be configured to generate and output an indicator or alarm signal, to alert a connected base station to the out-of-band signal problem.

Of course, even in correct operation the directional filter assembly 10 may pass a small amount of power to the isolated port 20 at frequencies at or close to the $f_1$ or $f_2$ frequency ranges. At these low levels of out-of-band signal power, the reflective protection device 24 is in its non-reflective state. In this state, the resistive load 22 dissipates the out-of-band signal power and it may be chosen or otherwise dimensioned in view of some normally expected level of out-of-band signal power for normal operation of the directional filter assembly 10.

If a base station 130, 132 is incorrectly connected to the directional filter assembly 10 then the signal generated by the base station 130, 132 is out-of-band with respect to the input port 16, 18 to which it is applied and it is therefore passed to the isolated port 20 and hence to the reflective protection device 24 and resistive load 22. In that case, if the power generated by the base station 130, 132 exceeds a defined power limit, then the reflective protection device 24 will be triggered, i.e., caused to change from the non-reflective state to the reflective state. In an example configuration, the reflective protection device 24 reflects out-of-band signals back into the isolated port 20, rather than allowing them to pass to the resistive load 22.

The out-of-band signal power level at which the reflective protection device 24 is triggered may be configured in consideration of expected normal power levels. In one embodiment, the reflective protection device 24 is adapted such that the triggering power level is less than the power generated by at least one correctly connected base station 130, 132. It therefore switches from the non-reflective state to the reflective state when, for example, the out-of-band power level is more than 10% and less than 90% of the power level in the microwave signal generated by the base station 130, 132. More preferably, the triggering power level or triggering threshold is more than 20% and less than 75%. A typical base station 130, 132 generates an average power level of the order 100 Watt (W). The power level at which the reflective protection device 24 triggers is therefore typically in the range 10 to 90 W, preferably in the range 20 to 75 W for an incorrectly connected base station 130, 132.

Thus, in at least one embodiment contemplated herein, the directional filter assembly 10 is configured as a microwave transmission assembly 140, wherein its multi-port filter circuit 12 is configured as a microwave combiner, for combining signals from, e.g., two different base stations 130, 132. In this configuration, the reflective protection device 24 of the directional filter assembly 10 is configured to switch from a low impedance state to a high impedance state when the incident microwave power of the out-of-band signals exceeds a power limit. In this manner, the reflective protection device 24 prevents the resistive load 22 of the directional filter assembly 10 from excessive power dissipation in the presence of abnormally high levels of out-of-band signal energy.

What is claimed is:

1. A directional filter assembly comprising:

a multi-port filter circuit for combining or separating signals in specified pass bands and an isolated port having a resistive load, for absorbing out-of-band signals; and a reflective protection device configured to protect the resistive load from being overpowered by out-of-band signal power, based on being configured to reflect or not reflect the out-of-band signals in dependence on a level of out-of-band signal power.

2. The directional filter assembly of claim 1, wherein said reflective protection device includes or is associated with a sensor configured to directly or indirectly sense a level of the out-of-band signal power, for triggering the reflective protection device to change from a non-reflective state to a reflective state.

3. The directional filter assembly of claim 2, wherein said sensor comprises a microwave power detector configured to detect the level of the out-of-band signal power at the isolated port and to generate a triggering signal responsive thereto, or a thermal sensor configured to detect the level of out-of-band signal power by sensing heating of the resistive load and to generate the triggering signal responsive thereto.

4. The directional filter assembly of claim 1, wherein said reflective protection device comprises a band-pass filter circuit that is positioned between the isolated port and the resistive load and is configured to reflect or not reflect the out-of-band signals in dependence on the level of out-of-band signal power.

5. The directional filter assembly of claim 4, wherein said band-pass filter circuit includes a resonator having a resonator element connected to a gas discharge tube (GDT) that is activated in dependence on the level of out-of-band signal power, and wherein activation of the GDT detunes the resonator, to change the band-pass filter circuit from the non-reflective state to the reflective state.

6. The directional filter assembly of claim 5, wherein one terminal of the GDT is grounded and the other terminal is connected to the resonator element.

7. The directional filter assembly of claim 4, wherein said band-pass filter circuit includes one or more resonators that are controlled in dependence on the level of out-of-band signal power.

8. The directional filter assembly of claim 7, wherein the one or more resonators include one or more actuator circuits that act on the one or more resonators, and wherein said one or more actuator circuits are triggered in dependence on the level of out-of-band signal power, to change the band-pass filter circuit from the non-reflective state to the reflective state.

9. The directional filter assembly of claim 1, wherein the reflective protection device comprises a shunt-connected circuit coupled to the isolated port, and wherein the shunt-connected circuit is configured to appear to the isolated port as a high-impedance shunt in a non-reflective state, and to appear as a low-impedance shunt when in a reflective state.

10. The directional filter assembly of claim 9, wherein the shunt-connected circuit comprises a leadless device coupled directly to a ground connection at one terminal.

11. The directional filter assembly of claim 9, wherein the shunt-connected circuit comprises a gas discharge tube (GDT).

12. The directional filter assembly of claim 11, further comprising a sensor configured to sense optic or other radiative energy from the GDT and an associated indicator circuit configured to output a signal indicating activation of said GDT.

13. The directional filter assembly of claim 1, wherein the reflective protection device comprises a gas discharge tube (GDT) connected to the isolated port in a shunt configuration, and further comprising a first series inductive element electrically positioned between the isolated port and the shunt-connected GDT and a second series inductive element positioned between the shunt-connected GDT and the resistive load, said first and second series inductive elements and said shunt-connected GDT thereby forming a low-pass filter that improves a return loss of the shunt-connected GDT.

14. The directional filter assembly of claim 13, further comprising a capacitor coupling said shunt-connected GDT to a common node between said first and second series inductive elements, said capacitor configured to mitigate an inductance of the shunt-connected GDT in its reflective state.

15. The directional filter assembly of claim 1, wherein said directional filter assembly is configured as a microwave transmission assembly, wherein said multiport filter circuit operates as a combiner having first and second input ports, an external output port, and an internal output port configured as the isolated port, said combiner adapted to:

transfer a signal received at a first microwave frequency range $f_1$ at the first input port to the external output port of the combiner and to transfer signals received at other frequencies to the isolated port for dissipation by the resistive load; and transfer a signal received at a second microwave frequency range $f_2$ at the second input port to the external output port and signals received at other frequencies to the isolated port; and wherein said reflective protection device is configured to reflect out-of-band signals away from the resistive load and back into the isolated port, in dependence on the level of out-of-band signal power.

16. The directional filter assembly of claim 15, wherein said microwave transmission assembly further comprises an antenna for transmitting a microwave signal, the antenna being connected to the external output port.

17. The directional filter assembly of claim 15, wherein at least one of the input ports of said microwave transmission assembly has a base station connected thereto, the base station being adapted to provide a microwave signal to the combiner.

18. The directional filter assembly of claim 17, wherein the power limit at which said reflective protection device switches from the non-reflective state to the reflective state is at least 10% and less than 90% of the power in the microwave signal generated by the base station and preferably is greater than 20% and less than 75%.

19. The directional filter assembly of claim 17, wherein the base station includes a detector for detecting power reflected from the combiner when said reflective protection device operates in its reflective state.

* * * * *